US011999585B2

(12) United States Patent
Yashita et al.

(10) Patent No.: US 11,999,585 B2
(45) Date of Patent: Jun. 4, 2024

(54) MEDIUM LOADING DEVICE AND RECORDING SYSTEM

(71) Applicant: SEIKO EPSON CORPORATION, Tokyo (JP)

(72) Inventors: Mio Yashita, Shiojiri (JP); Shun Ito, Matsumoto (JP); Masaki Namiki, Kitakyushu (JP); Haruna Takahashi, Ina (JP)

(73) Assignee: Seiko Epson Corporation, Tokyo (JP)

( * ) Notice: Subject to any disclaimer, the term of this patent is extended or adjusted under 35 U.S.C. 154(b) by 233 days.

(21) Appl. No.: 17/456,392

(22) Filed: Nov. 24, 2021

(65) Prior Publication Data

US 2022/0169475 A1 Jun. 2, 2022

(30) Foreign Application Priority Data

Nov. 27, 2020 (JP) ..... 2020-196909

(51) Int. Cl.
*B65H 35/04* (2006.01)
*B65H 31/26* (2006.01)

(52) U.S. Cl.
CPC ..... *B65H 35/04* (2013.01); *B65H 31/26* (2013.01); *B65H 2301/5151* (2013.01); *B65H 2701/1842* (2013.01)

(58) Field of Classification Search
CPC ..... B65H 35/04; B65H 31/26; B65H 2301/5151; B65H 2701/1842; B65H 2405/1111; B65H 2405/1112; B65H 2405/1114; B65H 2405/1118; B65H 31/22; B65H 31/02; B65H 2701/11312; B65H 2801/15
See application file for complete search history.

(56) References Cited

FOREIGN PATENT DOCUMENTS

JP 09-286558 A 11/1997

OTHER PUBLICATIONS

Minemura, Hideshi et al., "Recording Device", JP 2016179899 A, Oct. 13, 2016, Description Of Embodiments (Year: 2016).*

* cited by examiner

*Primary Examiner* — Lisa Solomon
(74) *Attorney, Agent, or Firm* — WORKMAN NYDEGGER

(57) ABSTRACT

A loading device includes a placement portion and a friction member. A single paper sheet discharged from a discharge unit is placed on the placement portion. The friction member is disposed downstream of a downstream end portion of the placement portion in a discharge direction, and includes a contact surface that can come into contact with a back surface, of the single paper sheet, facing the placement portion. The contact surface extends at least in the discharge direction, at a position lower than the height position of the downstream end portion in a height direction.

12 Claims, 8 Drawing Sheets

MEDIUM LOADING DEVICE AND RECORDING SYSTEM

The present application is based on, and claims priority from JP Application Serial Number 2020-196909, filed Nov. 27, 2020, the disclosure of which is hereby incorporated by reference herein in its entirety.

BACKGROUND

1. Technical Field

The present disclosure relates to a medium loading device and a recording system.

2. Related Art

A paper storage device described in JP-A-9-286558 includes a swingable stopper at the tip of a paper tray. In a state in which the stopper is standing upright, a discharged sheet is stopped by the stopper and stored in the paper tray.

In a configuration disclosed in JP-A-9-286558, on a placement portion on which a medium is placed, the medium is stopped by causing the stopper to stand upright. Thus, the placement portion needs to have substantially the same length, in a transport direction of the medium, as the length of the medium to be placed. In this way, in the configuration in which the medium is placed on the entire placement portion, there is a risk that the placement portion may increase in size in accordance with the medium that is long in the transport direction.

SUMMARY

A medium loading device according to the present disclosure for solving the above-described problem is a medium loading device on which is loaded a medium discharged from a discharge unit of a processing device. The medium loading device includes a placement portion on which at least one sheet of the medium discharged from the discharge unit is placed, and a friction member disposed downstream of a downstream end portion of the placement portion in a movement direction, at the placement portion, of the medium, and including a contact surface configured to come into contact with a back surface, of the medium, facing the placement portion. The contact surface extends at least in the movement direction at a position lower than a height position of the downstream end portion in a device height direction.

A recording system according to the present disclosure for solving the above-described problem is a recording system including a recording device and a medium loading device. The recording system includes a storage unit configured to store a recording medium, a transport unit configured to transport the recording medium from the storage unit, a recording unit configured to perform recording on the recording medium transported by the transport unit, and a discharge unit configured to discharge the recording medium on which the recording was performed by the recording unit. The medium loading device includes a placement portion on which at least one sheet of the recording medium discharged from the discharge unit is placed, and a friction member disposed downstream of a downstream end portion of the placement portion in a movement direction, at the placement portion, of the recording medium, and including a contact surface configured to come into contact with a back surface, of the recording medium, facing the placement portion. The contact surface extends at least in the movement direction at a position lower than a height position of the downstream end portion in a device height direction.

DESCRIPTION OF EXEMPLARY EMBODIMENTS

Figure 1:
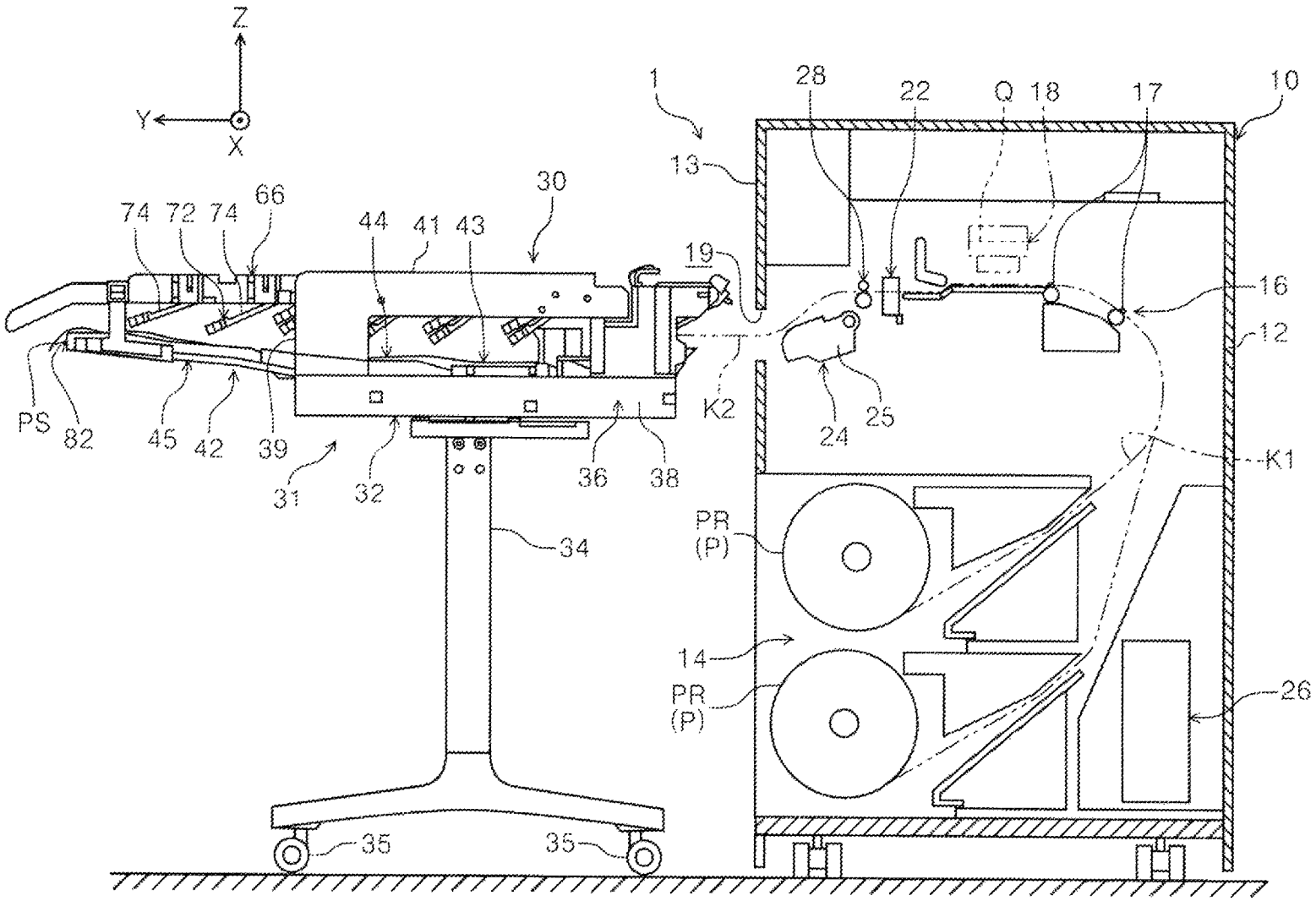
FIG. 1 is an overall configuration diagram of a recording system according to a first embodiment.

An overview of first to twelfth aspects of the present disclosure will be described below.

A medium loading device according to a first aspect of the present disclosure for solving the above-described problem is a medium loading device on which is loaded a medium discharged from a discharge unit of a processing device. The medium loading device includes a placement portion on which at least one sheet of the medium discharged from the discharge unit is placed, and a friction member disposed downstream of a downstream end portion of the placement portion in a movement direction, at the placement portion, of the medium, and including a contact surface configured to come into contact with a back surface, of the medium, facing the placement portion. The contact surface extends at least in the movement direction at a position lower than a height position of the downstream end portion in a device height direction. According to this aspect, the medium discharged from the discharge unit is placed on the placement portion while being moved in the movement direction. Here, since the contact surface of the friction member is located at a position lower than the height position of the downstream end portion in the device height direction, the downstream end of the medium in the movement direction does not easily come into contact with the friction member, and it is thus possible to inhibit the movement of the medium on the placement portion from being restricted.

Furthermore, when the length, in the movement direction, of the medium is longer than the length, in the movement direction, of the placement portion, a downstream portion of the medium moving on the placement portion protrudes from the placement portion, and hangs down under its own weight. Here, as a result of the contact surface coming into contact with the back surface of the medium, a frictional force acts on the medium in a direction opposite to the movement direction. Thus, it is possible to inhibit the medium from falling off from the placement portion. Then, even when the second sheet of the medium is placed on the first sheet of the medium, it is possible to inhibit the first sheet of the medium from being pushed out by the second sheet of the medium.

In this way, even when the length, in the movement direction, of the placement portion is shorter than the length, in the movement direction, of the medium, the medium is held in a state of being placed on the placement unit. Thus, the medium loading device can be downsized.

In the medium loading device according to a second aspect, with respect to the first aspect, a length corresponding to a difference, in the device height direction, between the height position of the downstream end portion and a height position of the contact surface is shorter than a length of the contact surface in the movement direction.

According to this aspect, compared to a configuration in which the length corresponding to the difference, in the device height direction, between the height position of the downstream end portion and the height position of the contact surface is longer than the length, in the movement direction, of the contact surface, a distance between the back surface of the medium and the friction member is reduced. Thus, the back surface can be easily brought into contact with the friction member.

In the medium loading device according to a third aspect, with respect to the first or second aspect, a coefficient of friction of the friction member is greater than a coefficient of friction of the placement portion.

According to this aspect, compared to a configuration in which the coefficient of friction of the friction member is the same as the coefficient of friction of the placement portion, the frictional force acting on the back surface of the medium is increased. Thus, the medium is easily held in a state in which the medium is placed on the placement portion.

In the medium loading device according to a fourth aspect, with respect to any one of the first to third aspects, the friction member is bonded to a side surface in the movement direction of the downstream end portion, or to a side surface of a bond portion disposed downstream of the downstream end portion, and a length, in the device height direction, of a bonding surface bonded to the side surface of the friction member is longer than a length, in the movement direction, of the contact surface.

According to this aspect, compared to a configuration in which the length, in the device height direction of the bonding surface is shorter than the length, in the movement direction, of the contact surface, the area of the bonding surface is increased. Thus, peeling of the friction member from the side surface can be suppressed.

In the medium loading device according to a fifth aspect, with respect to the first to third aspects, a step portion is formed at the downstream end portion, the step portion having a height position lower downstream than upstream in the movement direction, and the friction member is disposed at the step portion.

According to this aspect, since the friction member is supported by the step portion, it is possible to inhibit the friction member from falling off from the placement portion.

In the medium loading device according to a sixth aspect, with respect to any one of the first to fifth aspects, at least a portion of the contact surface includes a section having a downstream height position lower than an upstream height position in the movement direction.

According to this aspect, when the downstream portion of the medium moving in the movement direction has passed over the placement portion and hangs down, as the height position of the back surface becomes lower, the height position of the at least the portion of the contact surface also becomes lower. Thus, it is possible to inhibit the hanging-down portion of the medium from receiving an excessive reaction force acting in the movement direction as a result of coming into contact with the friction member.

In the medium loading device according to a seventh aspect, with respect to the first to sixth aspects, the friction member is an elastic member.

According to this aspect, when the back surface of the medium comes into contact with the friction member, the contact area between the back surface and the friction member is increased as a result of the friction member elastically deforming. Thus, the medium can be more easily held.

In the medium loading device according to an eighth aspect, with respect to the first to seventh aspects, an overhanging portion protruding in the movement direction at a position above the friction member in the device height direction is provided at a side portion, of the medium loading device, located downstream of the downstream end portion in the movement direction. According to this aspect, as a result of the overhanging portion covering a section between the side portion and the friction member from above, the downstream end of the medium does not easily enter between the side portion and the friction member. Thus, the peeling of the friction member from the side surface can be suppressed.

In the medium loading device according to a ninth aspect, with respect to the eighth aspect, in the device height direction, the overhanging portion is located below a virtual line connecting a downstream end, of the downstream end portion, located most downstream and a downstream end of the contact surface in the movement direction.

According to this aspect, the overhanging portion is less likely to come into contact with the back surface than with the downstream end of the contact surface. Thus, it is possible to inhibit the overhanging portion from limiting contact between the back surface and the contact surface.

In the medium loading device according to a tenth aspect, with respect to any one of the first to ninth aspects, an inclined surface is formed at a section, of the placement portion, upstream of the downstream end portion of the placement portion, and a position, in the device height direction, of the inclined surface becomes higher from upstream toward downstream in the movement direction.

According to this aspect, the medium discharged from the discharge unit is temporarily moved diagonally upward along the inclined surface. As a result, the medium is brought into an arrangement state in which a portion of the medium in the movement direction is formed in a mountain shape. In this way, the arrangement state of the medium becomes more stable with respect to a force acting in the movement direction, compared to a configuration in which the medium is in a linear shape in the movement direction. Thus, it is possible to inhibit the medium from falling off from the placement portion.

A recording system according to an eleventh aspect is a recording system including a recording device and a medium loading device. The recording device includes a storage unit configured to store a recording medium, a transport unit configured to transport the recording medium from the storage unit, a recording unit configured to perform recording on the recording medium transported by the transport unit, and a discharge unit configured to discharge the recording medium on which the recording was performed by the recording unit. The medium loading device includes a placement portion on which at least one sheet of the recording medium discharged from the discharge unit is placed, and a friction member disposed downstream of a downstream end portion of the placement portion in a movement direction of the recording medium at the placement portion, and including a contact surface configured to come into contact with a back surface, of the recording medium, facing the placement portion The contact surface extends at least in the movement direction at a position lower than a height position of the downstream end portion in a device height direction.

According to this aspect, the same effects as those of the first aspect can be obtained.

In the recording system according to a twelfth aspect, with respect to the eleventh aspect, the recording medium is roll paper. The recording device includes a cutting unit configured to cut the roll paper, on which the recording was performed by the recording unit, to form a single paper sheet, and the placement portion is configured to be loaded with a plurality of the single paper sheets.

According to this aspect, it is possible to inhibit the plurality of single paper sheets from falling off, and also to downsize the recording system.

An example of a recording system and a medium loading device according to the present disclosure will be described below in detail.

In each of the drawings, an X direction along an X-axis is an example of a device width direction of a loading device 30, 100, 110 described below, and of a medium width direction. A negative X direction is the leftward direction as viewed from a user when the user is facing the front face of the device, and a positive X direction is the rightward direction.

A Y direction along a Y-axis is an example of a device depth direction of the loading device 30, 100, 110. A positive Y direction is a direction from the rear face toward the front face of the device, and is an example of a movement direction of a single paper sheet PS placed on a placement portion 42, which will be described below. A negative Y direction is a direction from the front face toward the rear face of the device. The X and Y directions are both horizontal directions.

A Z direction along a Z-axis is a device height direction of the loading device 30, 100, 110 and the vertical direction. A positive Z direction is a vertically upward direction, and a negative Z direction is a vertically downward direction. The X direction, the Y direction, and the Z direction are orthogonal to each other.

A paper P is an example of a medium and a recording medium. In the following description, in order to make a distinction, the paper P in a rolled state will be referred to as roll paper PR, and the paper P cut into a sheet form will be referred to as the single paper sheet PS.

First Embodiment

As illustrated in FIG. 1, a recording system 1 according to the first embodiment includes a printer 10 as an example of a processing device and a recording device, and a loading device 30 as an example of the medium loading device.

The printer 10 includes a cuboid-shaped housing 12. Further, as an example, the printer 10 is configured as an ink-jet type printer capable of performing printing on the paper P having a size ranging from an A4 size to an A0 size.

Note that classification items of the paper P include not only the size, but also the bending rigidity of the paper P with respect to an external force acting in an out-of-plane direction of the paper P. Photo paper has a relatively high bending rigidity. Plain paper has a lower bending rigidity than that of the photo paper. In the printer 10, recording is possible on either the plain paper or the photo paper.

Specifically, the printer 10 includes, inside the housing 12, a storage unit 14, a transport unit 16, a recording unit 18, a cutting unit 22, and a discharge unit 24. Note that the printer 10 is provided with a control unit 26 configured to control operations of each of the units of the printer 10. As an example, the control unit 26 also functions as a control unit of the loading device 30 described below.

The housing 12 includes a sidewall 13 that constitutes a wall portion, in the positive Y direction, of the housing 12. A discharge port 19 that penetrates the sidewall 13 in the Y direction is formed in the sidewall 13. The discharge port 19 has a size that allows all sizes of the paper P usable in the printer 10 to pass through.

The storage unit 14 stores the roll paper PR that is rotated about a center axis along the X direction.

The transport unit 16 includes a plurality of transport rollers 17. Further, the transport unit 16 transports the roll paper PR pulled out from the storage unit 14 downstream along a transport path K1 indicated by an alternate long and two short dashes line.

The recording unit 18 performs recording on the roll paper PR transported by the transport unit 16, using an ink Q as an example of a liquid. Note that the roll paper PR is transported in the positive Y direction in a region facing the recording unit 18. Further, the recording unit 18 is positioned in the positive Z direction with respect to the roll paper PR. In other words, the recording is performed on the upper surface of the roll paper PR in the positive Z direction.

The cutting unit 22 cuts the roll paper PR on which recording has been performed by the recording unit 18, to form the single paper sheet PS as the medium.

The discharge unit 24 includes a support 25 disposed downstream of the cutting unit 22, and a discharge roller pair 28. The support 25 supports the single paper sheet PS and guides the single paper sheet PS to the discharge port 19. The discharge roller pair 28 feeds the single paper sheet PS to the discharge port 19 via the support 25, thereby discharging the single paper sheet PS from the discharge port 19 to the outside. In this way, the discharge unit 24 discharges the single paper sheet PS on which the recording has been performed by the recording unit 18.

The single paper sheet PS discharged from the discharge port 19 is transported to the loading device 30 along a transport path K2 indicated by an alternate long and two short dashes line. Note that path constituting members (not illustrated) are disposed at the transport path K2.

Next, the loading device 30 will be described.

The loading device 30 is a device onto which is loaded the single paper sheet PS discharged from the discharge unit 24. Further, the loading device 30 includes a device main body 31 and friction members 82.

As an example, the device main body 31 is provided with a base portion 32, the placement portion 42 which is provided at the base portion 32 and on which the single paper sheet PS is placed, opposing portions 66 facing the placement portion 42 in the Z direction, and a pressing unit 72 that presses the single paper sheet PS.

The opposing portions 66 face the placement portion 42 while being disposed above the placement portion 42, namely, are disposed further in the positive Z direction than the placement portion 42. Further, as an example, five of the opposing portions 66 are provided at intervals in the X direction.

The base portion 32 includes a leg frame 34 that stands upright in the Z direction, casters 35 that are rotatably provided at end portions in the negative Z direction of the leg frame 34, and a support frame 36 that is provided at an end portion in the positive Z direction of the leg frame 34. Then, the base portion 32 supports the placement portion 42, the opposing portions 66, and the friction members 82, from the negative Z direction. In this way, the loading device 30 is movable in the positive Y direction and the negative Y direction.

The support frame 36 includes a lower frame 38 supported by the leg frame 34, wall portions 39 that stand upright in the positive Z direction from both ends in the X direction of the lower frame 38, and an upper frame 41 that connects end portions in the positive Z direction of the wall portions 39 in the X direction.

At least one sheet of the single paper sheet PS discharged from the discharge section 24 is placed on the placement portion 42. In other words, a plurality of the single paper sheets PS can be loaded onto the placement portion 42. A movement direction of the single paper sheet PS on the placement portion 42 is the positive Y direction as an example. The placement portion 42 is constituted by a first placement portion 43, a second placement portion 44, and a third placement portion 45 disposed in this order from upstream toward downstream in the positive Y direction.

Figure 2:
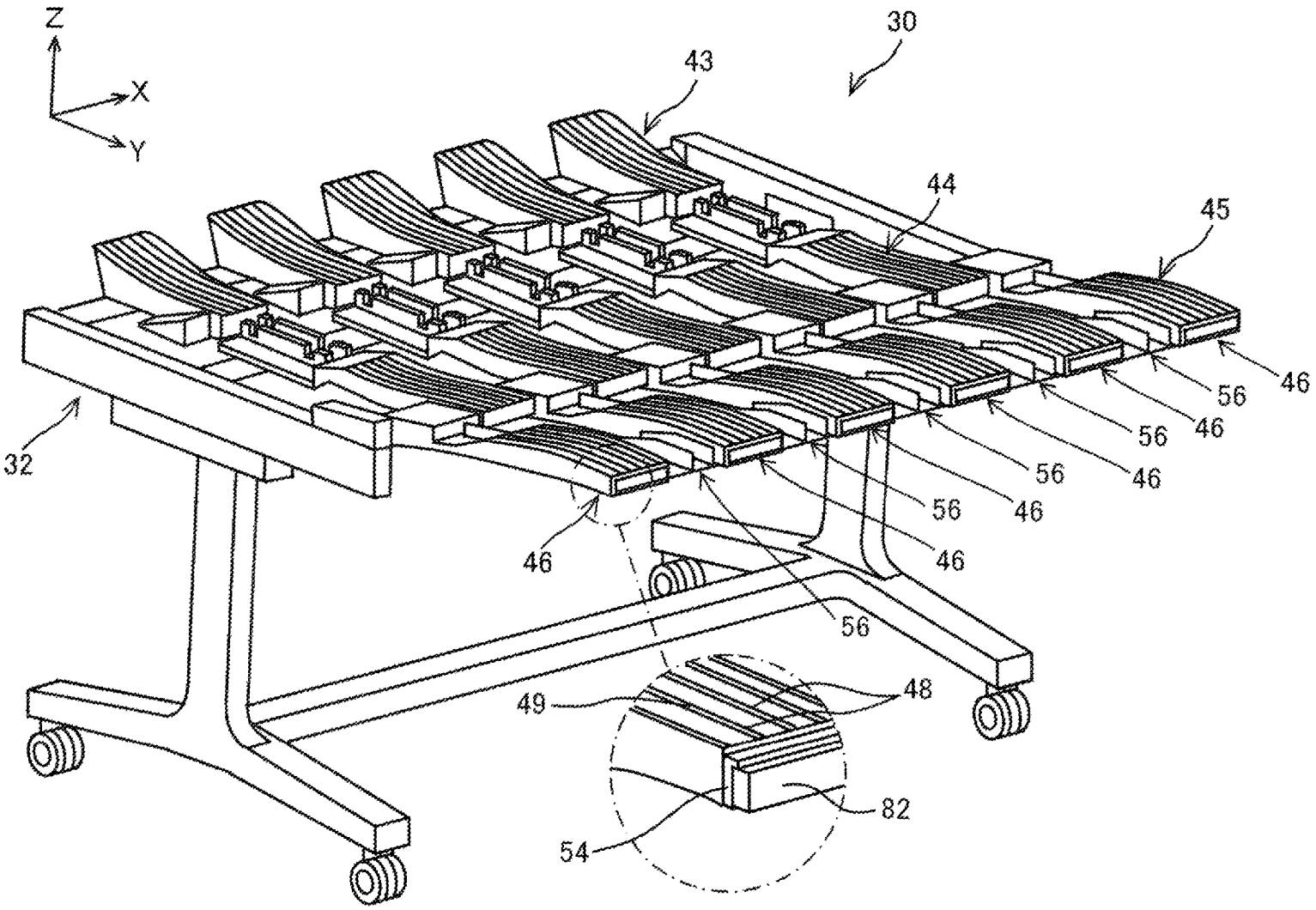
FIG. 2 is a perspective view illustrating a portion of a loading device according to the first embodiment.

As illustrated in FIG. 2, the first placement portion 43 and the second placement portion 44 are supported directly by the base portion 32.

The third placement portion 45 extends downstream from an end portion in the positive Y direction of the second placement portion 44, and is indirectly supported by the base portion 32 via the second placement portion 44. Further, as an example, the third placement portion 45 includes six main body portions 46 disposed at intervals in the X direction, and five coupling portions 56 that couple the six main body portions 46 in the X direction.

As an example, the main body portion 46 is constituted by a plurality of vertical plates 48 disposed at intervals in the X direction and a front plate 54 that connects the plurality of vertical plates 48 in the X direction. The vertical plate 48 has a predetermined thickness in the X direction and is disposed along the Y-Z plane. Further, the vertical plate 48 extends in the positive Y direction. A placement surface 49 is formed at an end portion in the positive Z direction of the vertical plate 48. The placement surface 49 includes an inclined surface 51 and a flat surface 52 (FIG. 4), as an example.

Figure 4:
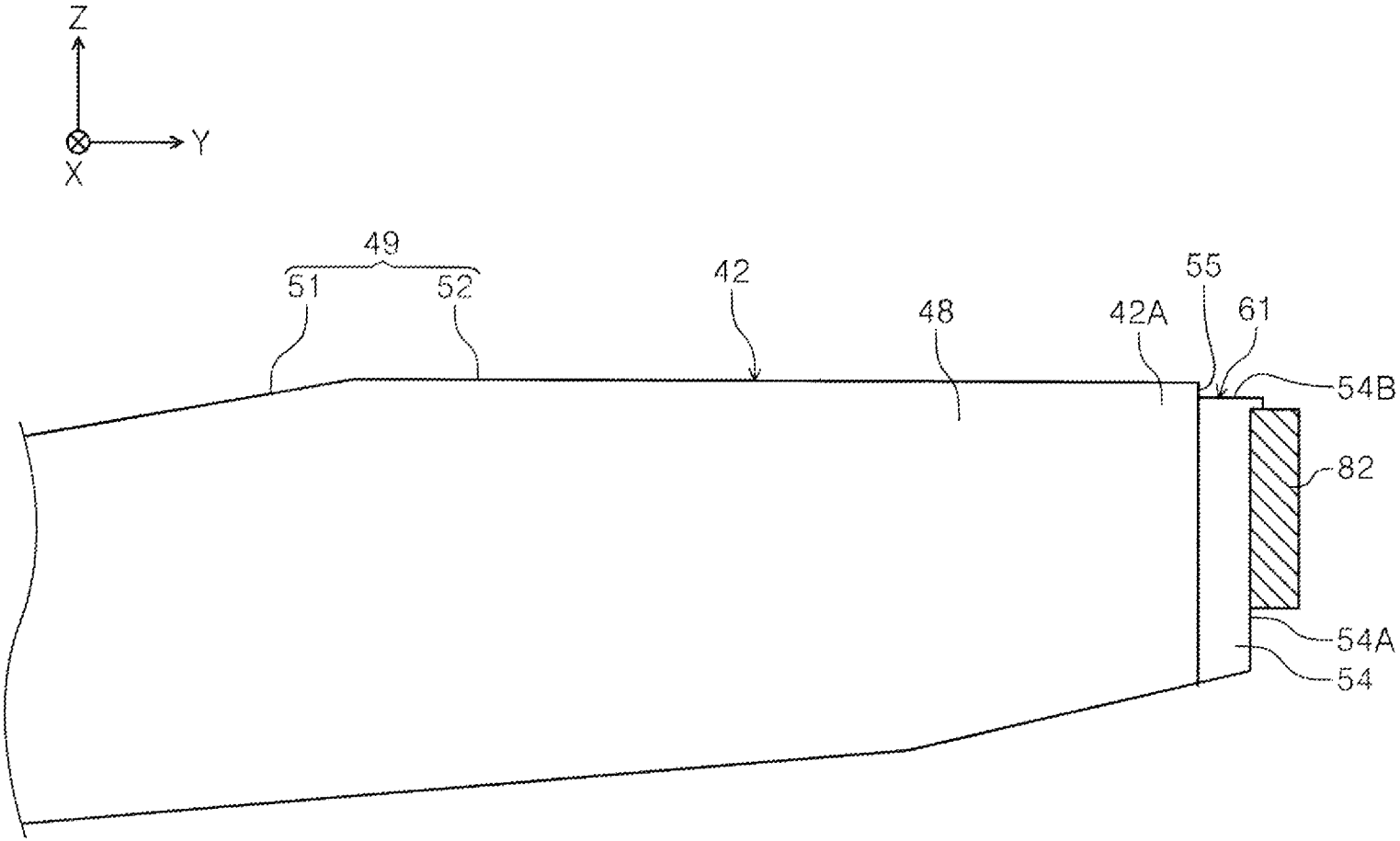
FIG. 4 is a side view illustrating the placement portion, an overhanging portion, and a friction member in the loading device according to the first embodiment.

As illustrated in FIG. 4, the inclined surface 51 is formed at a section upstream of a downstream end portion 42A in the positive Y direction of the placement portion 42. Further, the inclined surface 51 is positioned upstream of the flat surface 52. Specifically, the inclined surface 51 is a surface in which the position thereof becomes higher in the positive Z direction from upstream toward downstream in the positive Y direction. In other words, the inclined surface 51 is a surface extending diagonally upward so that the height position in the Z direction of an end portion thereof in the positive Y direction is higher than the height position in the Z direction of an end portion thereof in the negative Y direction.

The flat surface 52 is a surface along the X-Y plane.

The front plate 54 is an example of a side portion, and is an example of a bond portion to which the friction member 82, which will be described below, is bonded. Further, the front plate 54 has a predetermined thickness in the positive Y direction and is disposed along the X-Z plane. Further, the front plate 54 is formed in a rectangular shape having a dimension in the X direction greater than a dimension in the Z direction when viewed from the positive Y direction. The friction member 82 is bonded to a side surface 54A in the positive Y direction of the front plate 54.

Here, an end surface in the positive Y direction of the downstream end portion 42A is a side surface 55. Further, an end surface in the positive Z direction of the front plate 54 is an upper surface 54B. In the Z direction, the height position of the upper surface 54B is lower than the height position of the placement surface 49. In other words, a step portion 61 is formed by the side surface 55 and the upper surface 54B.

Figure 3:
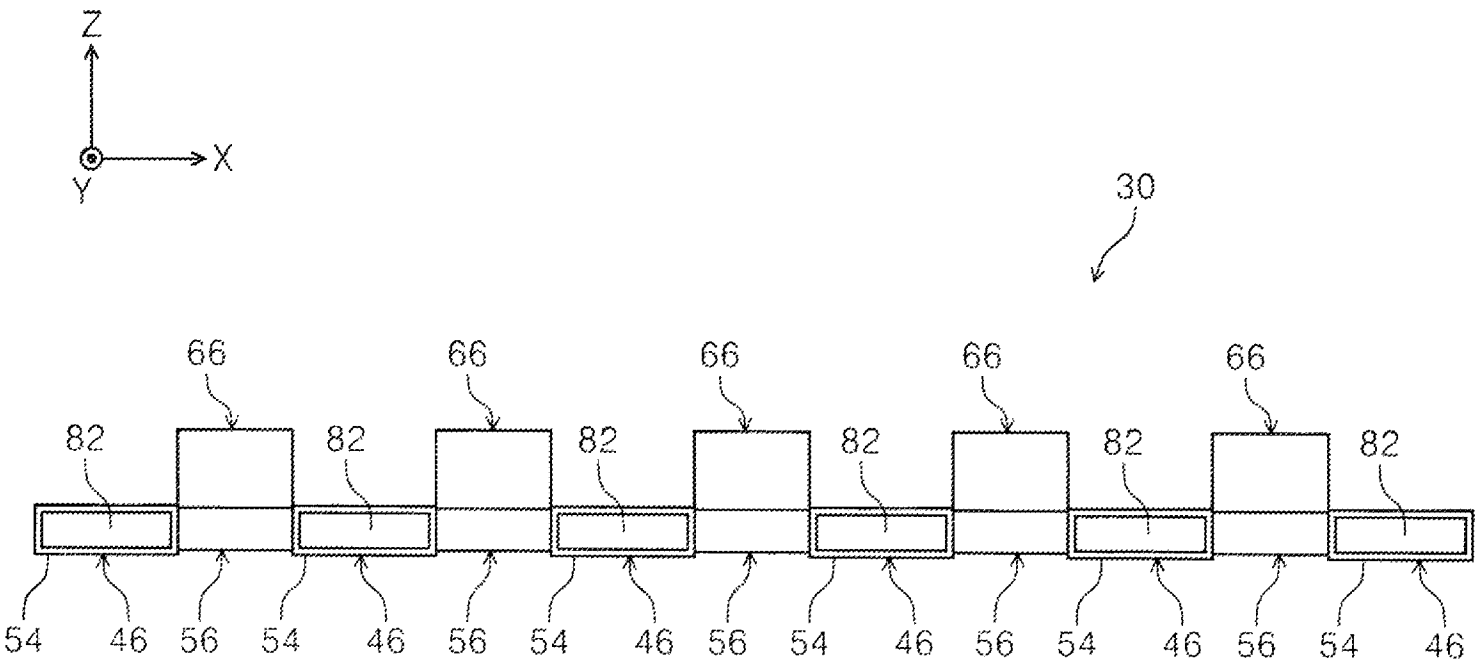
FIG. 3 is a front view illustrating a placement portion and an opposing portion in the loading device according to the first embodiment.

As illustrated in FIG. 3, when viewed from the positive Y direction, the six main body portions 46 and the five opposing portions 66 are arranged in a staggered manner so as not to be aligned with each other in the Z direction. Further, the five coupling portions 56 are aligned with the five opposing portions 66 in the Z direction. The six front plates 54 have the same height position in the Z direction, and are arranged side by side in the X direction.

As illustrated in FIG. 1, the pressing unit 72 is constituted by a plurality of pressing members 74 provided at the opposing portions 66 at intervals in the Y direction.

The pressing member 74 extends diagonally downward from the opposing portion 66 so that a downstream end thereof in the positive Y direction is positioned further in the negative Z direction than an upstream end thereof. One end portion in the extending direction of the pressing member 74 is rotatably coupled to the opposing portion 66. A roller (not illustrated) is rotatably supported by another end portion in the extending direction of the pressing member 74. The outer circumferential surface of the roller can come into contact with the upper surface of the single paper sheet PS that is positioned furthest in the positive Z direction, of the loaded single paper sheets PS.

When a loaded amount of the loaded single paper sheets PS changes, the pressing member 74 swings and changes the height position thereof in the Z direction. Note that the pressing member 74 is not configured to correct curling of both the end portions in the X direction of the single paper sheet PS.

Figure 5:
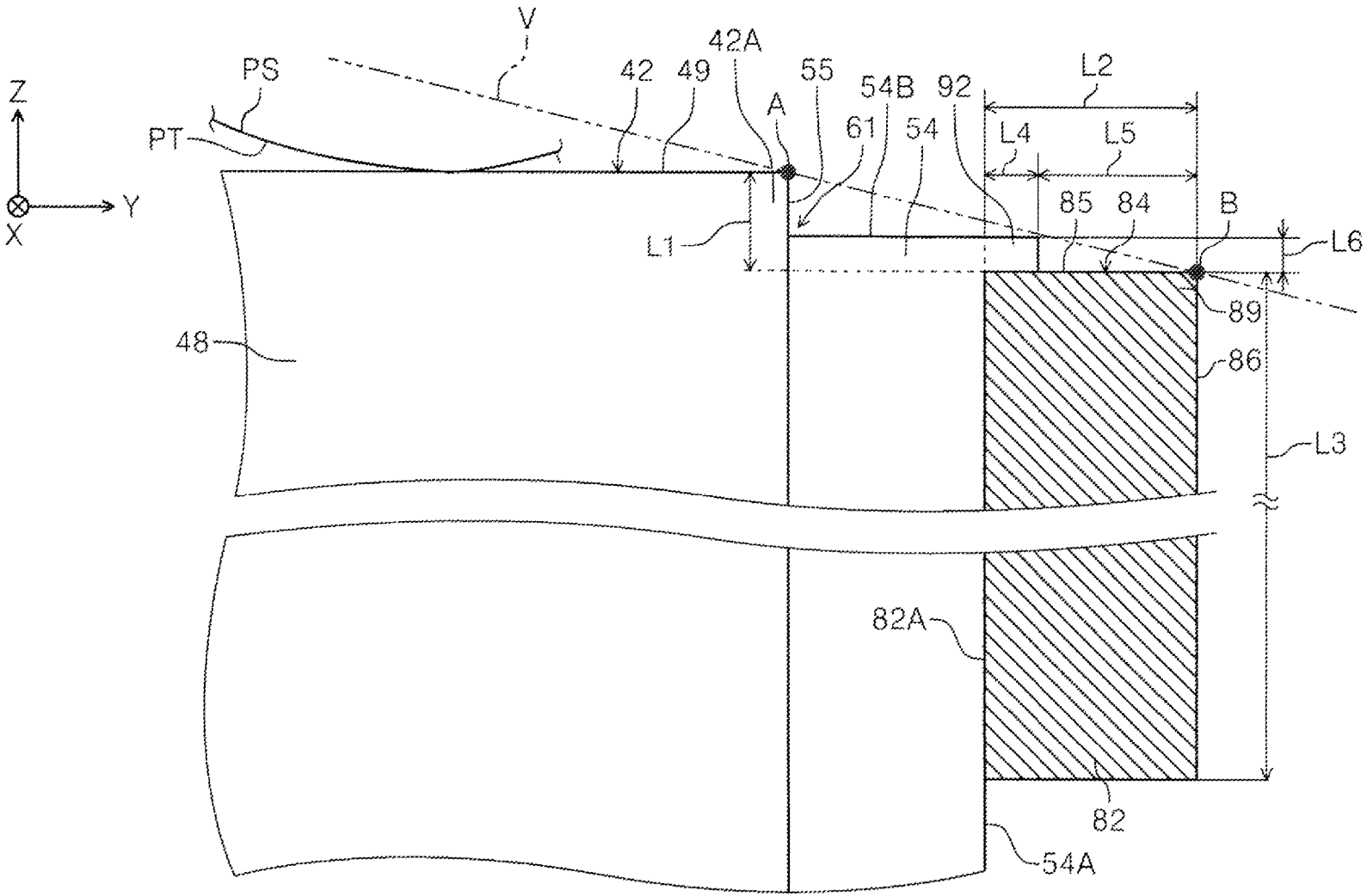
FIG. 5 is a schematic diagram illustrating an arrangement relationship between the placement portion, the overhanging portion, and the friction portion in the loading device according to the first embodiment.

As illustrated in FIG. 5, the friction member 82 is disposed downstream of the downstream end portion 42A of the placement portion 42 in the positive Y direction. As an example, the friction member 82 is formed in a plate shape having a predetermined thickness in the Y direction. Further, the friction member 82 is formed in a rectangular shape having a dimension in the X direction greater than a dimension in the Z direction when viewed from the positive Y direction. For example, Eptsealer (registered trademark) can be used as the friction member 82.

The friction member 82 is an example of an elastic member that can restore itself when an external force is applied thereto.

A coefficient of dynamic friction $\mu 1$, which is a coefficient of friction between the friction member 82 and the single paper sheet PS, is greater than a coefficient of dynamic friction $\mu 2$, which is a coefficient of friction between the placement portion 42 and the single paper sheet PS. Note that the coefficients of dynamic friction $\mu 1$ and $\mu 2$ are not illustrated in the drawing.

Further, the friction member 82 includes a contact surface 84 that can come into contact with a back surface PT, of the single paper sheet PS, facing the placement portion 42.

The contact surface 84 extends at least in the positive Y direction, at a position lower than the height position of the downstream end portion 42A in the Z direction. Specifically, the contact surface 84 is constituted by an upper surface 85 in the positive Z direction of the friction member 82 and an end surface 86 in the positive Y direction of the friction member 82.

As an example, the upper surface 85 is a flat surface along the X-Y plane. As an example, the end surface 86 is a flat surface along the X-Z plane. A portion formed by an end portion in the positive Y direction of the upper surface 85 and an end portion in the positive Z direction of the end surface 86 is referred to as a corner portion 89.

A length L1 corresponding to a difference, in the Z direction, between the height position of the downstream end portion 42A and the height position of the contact surface 84 is shorter than a length L2 in the positive Y direction of the contact surface 84.

The friction member 82 is bonded, from the positive Y direction, to the side surface 54A of the front plate 54 disposed downstream of the downstream end portion 42A in the positive Y direction. A surface, of the friction member 82, bonded to the side surface 54A is referred to as a bonding surface 82A. A length L3 in the Z direction of the bonding surface 82A is longer than the length L2 in the positive Y direction of the contact surface 84.

The front plate 54 includes an overhanging portion 92.

As an example, the overhanging portion 92 protrudes in the positive Y direction from an end portion in the positive Z direction of the front plate 54, while being disposed above the friction member 82 in the Z direction. Note that the overhanging portion 92 may protrude in the positive Y direction from the side surface 55 of the downstream end portion 42A.

Specifically, the overhanging portion 92 is formed in a plate shape having a predetermined thickness in the Z direction and extending in the X direction. The length corresponding to a protrusion amount of the overhanging portion 92 in the positive Y direction is referred to as a length L4. The length L4 is shorter than half of the length L2, as an example. A length L6 corresponding to the thickness of the overhanging portion 92 in the Z direction is preset so that deformation in the Z direction of the overhanging portion 92 is suppressed.

The length of a section from which the contact surface 84 is exposed in the positive Y direction is referred to as a length L5. The length L5 corresponds to a difference between the length L2 and the length L4.

The position of a downstream end, of the downstream end portion 42A, located most downstream in the positive Y direction is indicated by a point A. Further, the position of a downstream end of the contact surface 84 in the positive Y direction is indicated by a point B. Then, a straight line passing through the point A and the point B is referred to as a virtual line V. The overhanging portion 92 is located in the negative Z direction with respect to the virtual line V, that is, is located below the virtual line V in the Z direction.

Further, the overhanging portion 92 also functions as a reference for the bonding position in the Z direction, when bonding the friction member 82.

Next, effects of the recording system 1 and the loading device 30 according to the first embodiment will be described. Note that it is assumed that each configuration of the recording system 1 and the loading device 30 is described below with reference to FIG. 1 to FIG. 5, so reference to individual drawing numbers will be omitted. The length in the positive Y direction of the single paper sheet PS is longer than the length in the positive Y direction of the placement portion 42, as an example.

Figure 6:
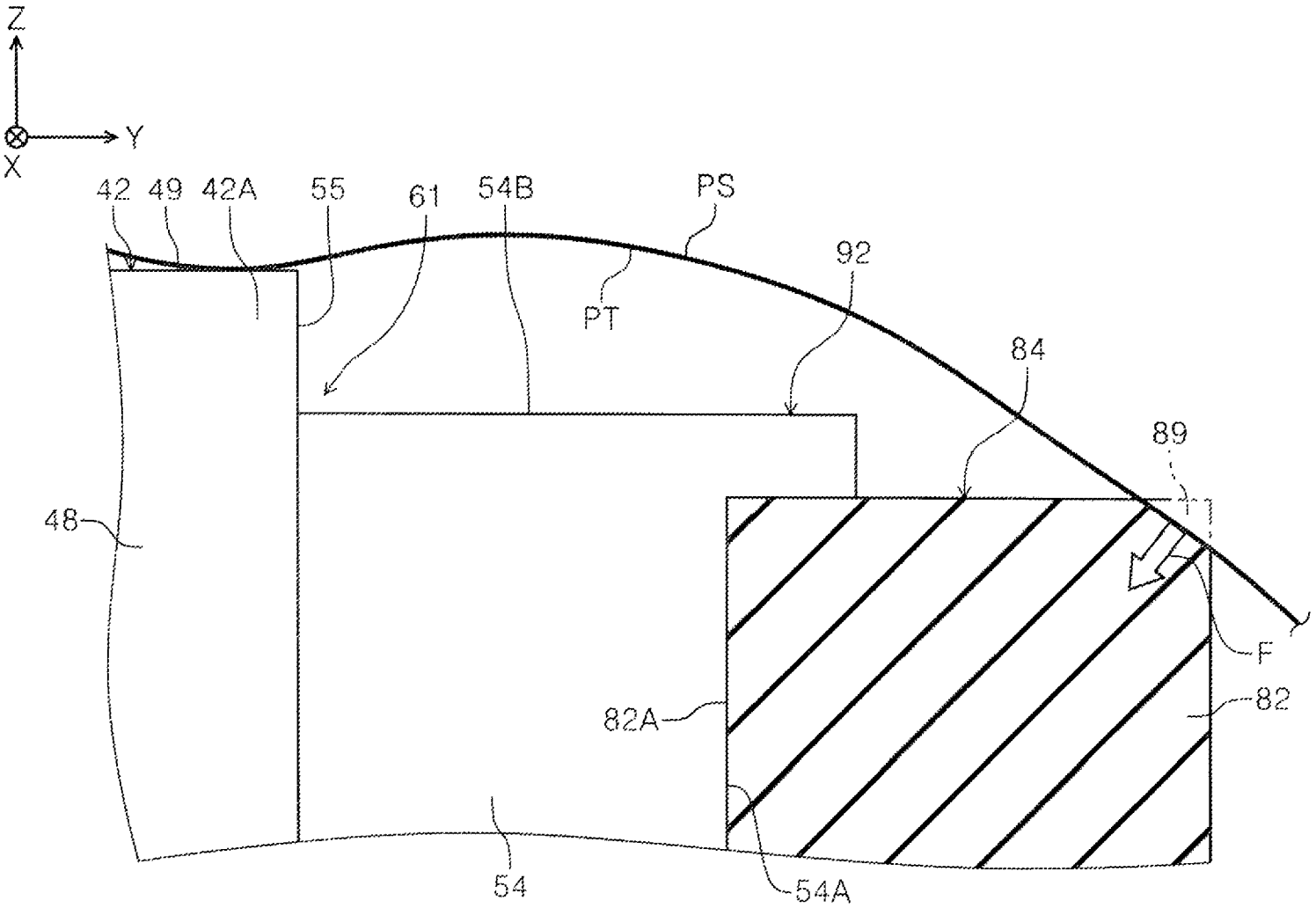
FIG. 6 is a schematic diagram illustrating a state in which a tip portion of a single paper sheet comes into contact with the friction member in the loading device according to the first embodiment.

As illustrated in FIG. 6, the single paper sheet PS discharged from the discharge unit 24 (FIG. 1) moves on the placement portion 42 in the positive Y direction. A central portion and an upstream portion in the positive Y direction of the single paper sheet PS is placed on the placement surface 49, but a downstream portion in the positive Y direction of the single paper sheet PS moves downstream in the positive Y direction beyond the placement portion 42. Note that the back surface PT of the single paper sheet PS comes into contact with only the placement surface 49 until the downstream portion of the single paper sheet PS passes over the placement portion 42 in the positive Y direction. Thus, compared to a case in which the single paper sheet PS comes into contact with a member having a coefficient of friction higher than the coefficient of friction of the placement surface 49, the movement of the single paper sheet PS in the positive Y direction is not easily inhibited.

Subsequently, the downstream portion of the single paper sheet PS, which has passed over the placement portion 42, hangs down under its own weight in the negative Z direction. Here, since the overhanging portion 92 is located below the virtual line V (FIG. 5) in the Z direction, the downstream portion of the single paper sheet PS does not easily come into contact with the overhanging portion 92. Thus, the hanging-down downstream portion of the single paper sheet PS first comes into contact with the corner portion 89 before coming into contact with the overhanging portion 92.

The corner portion 89 is elastically deformed diagonally downward as a result of receiving a load F from the single paper sheet PS. As a result, compared to a case in which the single paper sheet PS comes into contact with an apex portion of the corner portion 89, the contact area between the single paper sheet PS and the friction member 82 increases. Then, the movement of the downstream portion of the single paper sheet PS in the positive Y direction and the negative Z direction is stopped by a reaction force, that is, a restoring force acting on the single paper sheet PS from the corner portion 89, and a frictional force generated between the friction member 82 and the single paper sheet PS. In other words, the single paper sheet PS does not fall, and is brought into a state of being supported by the placement portion 42.

As described above, according to the loading device 30, the single paper sheet PS discharged from the discharge unit 24 is placed on the placement portion 42 while being moved in the positive Y direction. Here, since the contact surface 84 of the friction member 82 is located at a position lower than the height position of the downstream end portion 42A in the Z direction, the downstream end of the single paper sheet PS in the positive Y direction does not easily come into contact with the friction member 82, and it is thus possible to inhibit the movement of the single paper sheet PS on the placement portion 42 in the positive Y direction from being restricted.

Furthermore, when the length in the positive Y direction of the single paper sheet PS is longer than the length in the positive Y direction of the placement portion 42, the downstream portion of the single paper sheet PS moving on the placement portion 42 protrudes from the placement portion 42, and hangs down under its own weight. Here, as a result of the contact surface 84 coming into contact with the back surface PT of the single paper sheet PS, a frictional force acts on the single paper sheet PS in a direction opposite to the positive Y direction. Thus, it is possible to inhibit the single paper sheet PS from falling off from the placement portion 42. Then, even when the second single paper sheet PS is placed on the first single paper sheet PS, it is possible to inhibit the first single paper sheet PS from being pushed out by the second single paper sheet PS. The same applies to the third and subsequent single sheet papers PS.

In this way, even when the length in the positive Y direction of the placement portion 42 is shorter than the length in the positive Y direction of the single paper sheet PS, the single paper sheet PS is held in a state in which the single paper sheet PS is placed on the placement portion 42. Thus, compared to a configuration in which a placement portion having the same length as the length of the single paper sheet PS is used, the loading device 30 can be downsized.

According to the loading device 30, compared to a configuration in which the length L1 corresponding to the difference, in the Z direction, between the height position of the downstream end portion 42A and the height position of the contact surface 84 is longer than the length L2 in the positive Y direction of the contact surface 84, a distance between the back surface PT of the single paper sheet PS and the friction member 82 is reduced. Thus, the back surface PT can be easily brought into contact with the friction member 82.

According to the loading device 30, compared to a configuration in which the coefficient of friction of the friction member 82 is the same as the coefficient of friction of the placement portion 42, the frictional force acting on the back surface PT of the single paper sheet PS is increased. Thus, the single paper sheet PS is easily held in a state in which the single paper sheet PS is placed on the placement portion 42.

According to the loading device 30, compared to a configuration in which the length L3 in the Z direction of the bonding surface 82A is shorter than the length L2 in the positive Y direction of the contact surface 84, the area of the bonding surface 82A is increased. Thus, peeling of the friction member 82 from the side surface 54A can be suppressed.

According to the loading device 30, when the back surface PT of the single paper sheet PS comes into contact with the friction member 82, the contact area between the back surface PT and the friction member 82 is increased as a result of the friction member 82 elastically deforming. Thus, the single paper sheet PS can be more easily held.

According to the loading device 30, as a result of the overhanging portion 92 covering a section between the front plate 54 and the friction member 82 from above, the downstream end of the single paper sheet PS does not easily enter between the front plate 54 and the friction member 82. Thus, the peeling of the friction member 82 from the side surface 54A can be suppressed. Further, by abutting the friction member 82 against the overhanging portion 92, the overhanging portion 92 can be used as a positioning portion of the friction member 82. Furthermore, even if an adhesive material or an adhesive for bonding the friction member 82 to the front plate 54 spills over in the positive Z direction, since the overhanging portion 92 covers the section between the front plate 54 and the friction member 82 from above, it is possible to inhibit the adhesive material or the adhesive from becoming attached to the single paper sheet PS.

According to the loading device 30, since the overhanging part 92 is positioned below the virtual line V in the Z direction, the overhanging portion 92 is less likely to come into contact with the back surface PT than with the downstream end of the contact surface 84. Thus, it is possible to inhibit the overhanging portion 92 from limiting contact between the back surface PT and the contact surface 84.

According to the loading device 30, the single paper sheet PS discharged from the discharge unit 24 is temporarily moved diagonally upward along the inclined surface 51. As a result, the single paper sheet PS is brought into an arrangement state in which a portion of the single paper sheet PS in the positive Y direction is formed in a mountain shape. In this way, the arrangement state of the single paper sheet PS becomes more stable with respect to a force acting in the positive Y direction, compared to a configuration in which the single paper sheet PS is in a linear shape in the positive Y direction. Thus, it is possible to inhibit the single paper sheet PS from falling off from the placement portion 42.

According to the recording system 1, effects similar to those of the loading device 30 can be obtained. Further, according to the recording system 1, it is possible to inhibit the plurality of single paper sheets PS from falling off, and also to downsize the recording system 1.

Second Embodiment

Next, a loading device 100 according to a second embodiment, which is an example of the medium loading device, will be described with reference to the accompanying drawings. Note that portions common to those of the loading device 30 according to the first embodiment will be denoted by the same reference signs, and a description thereof will be omitted. Further, the loading device 100 is provided in the printer 10 according to the first embodiment instead of the loading device 30. Thus, the description of the printer 10 and the recording system 1 will be omitted.

Figure 7:
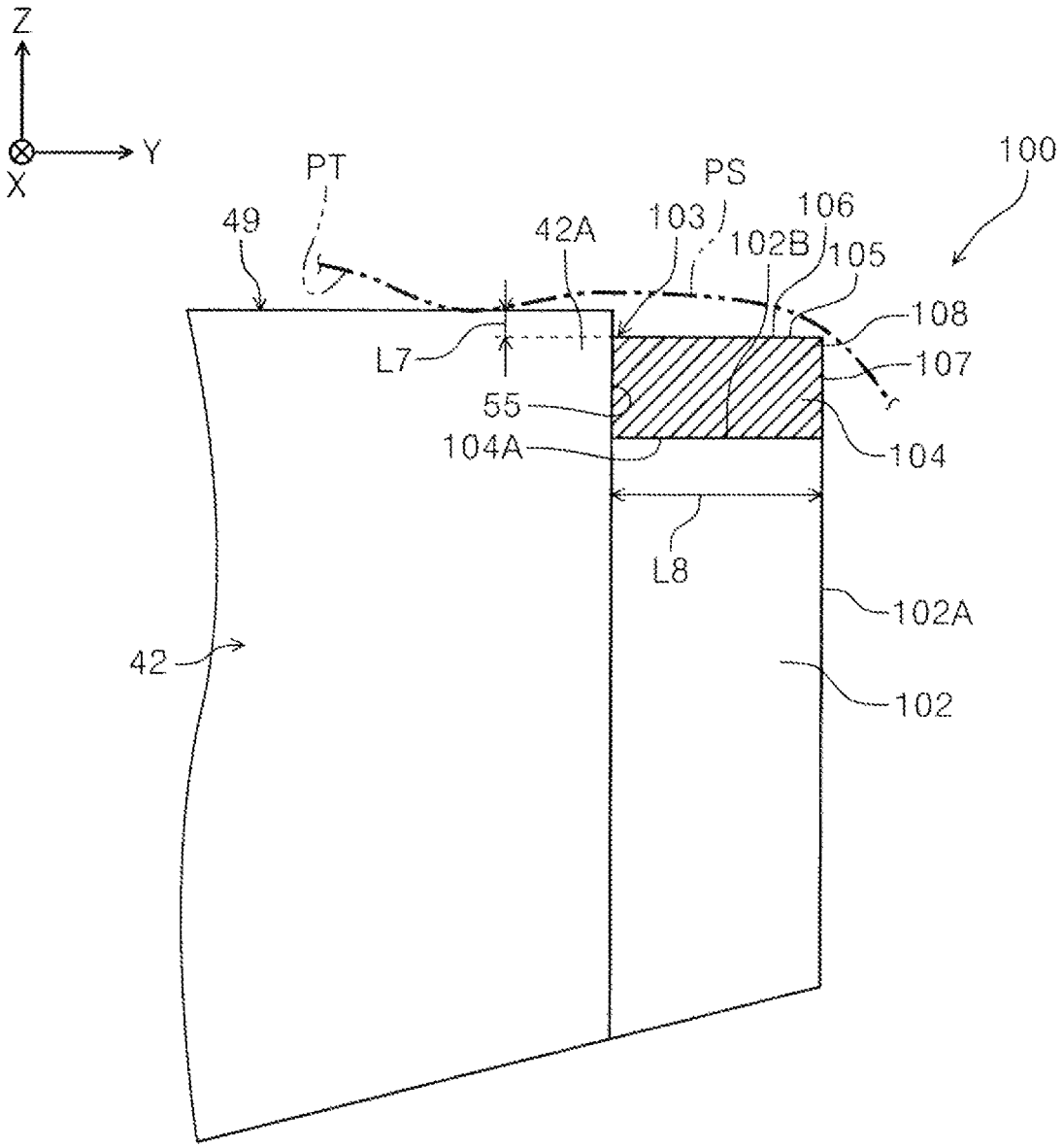
FIG. 7 is a schematic diagram illustrating the placement portion and the friction member in a loading device according to a second embodiment.

A portion of the loading device 100 is illustrated in FIG. 7. In place of the front plate 54, the friction member 82, and the overhanging portion 92 in the loading device 30 (FIG. 5), the loading device 100 includes a front plate 102 and a friction member 104. Note that, in the loading device 100, portions other than the front plate 102 and the friction member 104 are the same as those of the loading device 30.

The front plate 102 is an example of the bond portion to which the friction member 104 is bonded. Further, the front plate 102 has a predetermined thickness in the positive Y direction and is disposed along the X-Z plane. Further, the front plate 102 is formed in a rectangular shape having a dimension in the X direction greater than a dimension in the Z direction when viewed from the positive Y direction. A side surface 102A in the positive Y direction of the front plate 102 is exposed.

An end surface in the positive Z direction of the front plate 102 is an upper surface 102B. In the Z direction, the height position of the upper surface 102B is lower than the height position of the placement surface 49. In this way, a step portion 103 is formed at the downstream end portion 42A, such that the height position in the Z direction is lower downstream than upstream in the positive Y direction. In other words, the step portion 103 is formed by the side surface 55 and the upper surface 102B.

The friction member 104 is disposed downstream of the downstream end portion 42A of the placement portion 42 in the positive Y direction, so as to form the step portion 103. As an example, the friction member 104 is formed in a plate shape having a predetermined thickness in the Z direction. The front plate 104 is formed in a rectangular shape having a dimension in the X direction greater than a dimension in the Y direction when viewed from the positive Z direction. For example, Eptsealer (registered trademark) can be used as the friction member 104.

The friction member 104 is an example of an elastic member that can restore itself when an external force is applied thereto.

A coefficient of dynamic friction μ3, which is a coefficient of friction between the friction member 104 and the single paper sheet PS, is greater than the coefficient of dynamic friction μ2, which is the coefficient of friction between the placement portion 42 and the single paper sheet PS. Note that the coefficients of dynamic friction μ2 and μ3 are omitted in the drawing.

Further, the friction member 104 includes a contact surface 105 that can come into contact with the back surface PT, of the single paper sheet PS, facing the placement portion 42.

The contact surface 105 extends at least in the positive Y direction, at a position lower than the height position of the downstream end portion 42A in the Z direction. Specifically, as an example, the contact surface 105 is constituted by an upper surface 106 in the positive Z direction of the friction member 104 and an end surface 107 in the positive Y direction of the friction member 104.

As an example, the upper surface 106 is a flat surface along the X-Y plane. As an example, the end surface 107 is a flat surface along the X-Z plane. A portion formed by an end portion in the positive Y direction of the upper surface 106 and an end portion in the positive Z direction of the end surface 107 is referred to as a corner portion 108.

A length L7 corresponding to a difference, in the Z direction, between the height position of the downstream end portion 42A and the height position of the contact surface 105 is shorter than a length L8 in the positive Y direction of the contact surface 105.

The friction member 104 is bonded to the upper surface 102B of the front plate 102 from the positive Z direction. The length L8, in the Y direction, of a bonding surface 104A of the friction member 104, which has been bonded to the upper surface 102B, is longer than the length L7 in the positive Z direction of the side surface 55.

Next, effects of the loading device 100 will be described.

According to the loading device 100, since the friction member 104 is supported by the step portion 103, it is possible to inhibit the friction member 104 from falling off from the placement portion 42.

Third Embodiment

Next, a loading device 110 according to a third embodiment, which is an example of the medium loading device, will be described with reference to the accompanying drawings. Note that portions common to those of the loading device 30 will be denoted by the same reference signs, and a description thereof will be omitted. Further, the loading device 110 is provided in the printer 10 according to the first embodiment instead of the loading device 30. Thus, the description of the printer 10 and the recording system 1 will be omitted.

Figure 8:
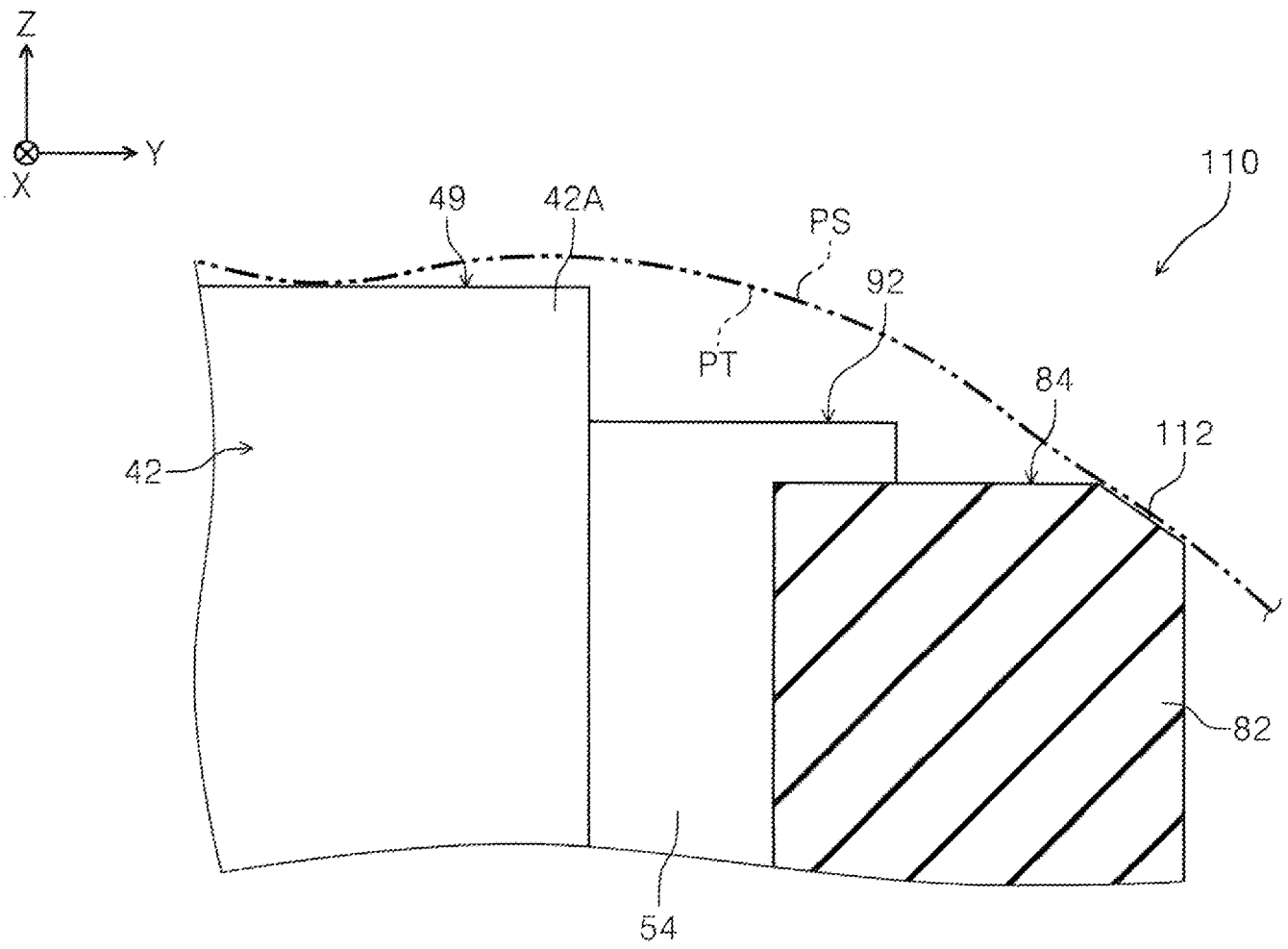
FIG. 8 is a schematic diagram illustrating the placement portion and the friction member in a loading device according to a third embodiment.

A portion of the loading device 110 is illustrated in FIG. 8. The loading device 110 is configured differently from the loading device 30 (FIG. 5) in that a tapered surface 112 is formed at the friction member 82 in the loading device 30. Note that portions other than the tapered surface 112 are the same as those of the loading device 30. The tapered surface 112 is an example of a portion of the contact surface 84. Further, the tapered surface 112 is a section whose height position becomes lower from upstream toward downstream in the positive Y direction. In other words, the tapered surface 112 is an inclined surface that is formed by diagonally cutting the corner 89 (FIG. 5) when viewed from the X direction. The tapered surface 112 is formed at a section, of the friction member 82, with which the back surface PT of the single paper sheet PS comes into contact.

Next, effects of the loading device 110 will be described.

According to the loading device 110, when the downstream portion of the single paper sheet PS moving in the positive Y direction has passed over the placement portion 42 and hangs down, as the height position of the back surface PT becomes lower, the height position of the portion of the contact surface 84 also becomes lower. Thus, it is possible to inhibit the hanging-down portion of the single paper sheet PS from receiving an excessive reaction force acting in the positive Y direction as a result of coming into contact with the friction member 82.

Further, by forming the tapered surface 112, the contact area between the friction member 82 and the single paper sheet PS can be increased, and it is also possible to inhibit the tip, that is, the downstream end of the single paper sheet PS from becoming caught on the friction member 82.

Although the printer 10 and the loading devices 30, 100, 110 according to the first to third embodiments of the present disclosure are based on such configurations as described above, as a matter of course, modifications, omissions, and the like may be made to a partial configuration without departing from the gist of the disclosure of the present application.

In the loading device 30, the length L1 corresponding to the difference, in the Z direction, between the height position of the downstream end portion 42A and the height position of the contact surface 84 may be longer than the length L2 in the positive Y direction of the contact surface 84.

The length L3 in the Z direction of the bonding surface 82A bonded to the side surface 54A of the friction member 82 may be shorter than the length L2 in the positive Y direction of the contact surface 84.

The friction member 82 is not limited to being an elastic member such as a sponge or rubber, and may be a member made from resin. Further, the friction member 82 may be bonded to a side surface in the positive Y direction of the downstream end portion 42A.

The overhanging portion 92 may extend in the positive Y direction from the downstream end portion 42A. Further, the overhanging portion 92 may be located above the virtual line V in the Z direction.

The placement portion 42 may include a placement surface constituted only of the flat surface 52.

The configuration of the printer 10 is not limited to the configuration including the cutting unit 22 configured to cut the roll paper PR, and may have a configuration in which a sheet-shaped medium that has already been cut is used.

The recording unit 18 may be a serial recording head or a line head. The processing device is not limited to the ink-jet type printer 10, and may be an electrophotographic printer. Furthermore, the processing device is not limited to a printer, and may be, for example, a device that performs coating on a surface of a medium.

An alignment method of the paper P in the loading devices 30, 100, 110 is not limited to a center resist method in which the center in the X direction of the device is aligned with the center of the paper P, but may be a side resist method in which the paper P is arranged while being aligned against a side in the positive X direction or the negative X direction.

What is claimed is:

1. A medium loading device on which is loaded a medium discharged from a discharge unit of a processing device, the medium loading device comprising:

a placement portion on which at least one sheet of the medium discharged from the discharge unit is placed; and a friction member disposed downstream of a downstream end portion of the placement portion in a movement direction, at the placement portion, of the medium, and including a contact surface configured to come into contact with a back surface, of the medium, facing the placement portion, wherein the contact surface extends at least in the movement direction at a position lower than a height position of the downstream end portion in a device height direction, wherein the medium loading device is a device that is separate from the processing device.

2. The medium loading device according to claim 1, wherein a length corresponding to a difference, in the device height direction, between the height position of the downstream end portion and a height position of the contact surface is shorter than a length of the contact surface in the movement direction.

3. The medium loading device according to claim 1, wherein a coefficient of friction of the friction member is greater than a coefficient of friction of the placement portion.

4. The medium loading device according to claim 1, wherein the friction member is bonded to a side surface in the movement direction of the downstream end portion, or to a side surface of a bond portion disposed downstream of the downstream end portion, and a length, in the device height direction, of a bonding surface bonded to the side surface of the friction member is longer than a length, in the movement direction, of the contact surface.

5. The medium loading device according to claim 1, wherein a step portion is formed at the downstream end portion, the step portion having a height position lower downstream than upstream in the movement direction, and the friction member is disposed at the step portion.

6. The medium loading device according to claim 1, wherein at least a portion of the contact surface includes a section having a downstream height position lower than an upstream height position in the movement direction.

7. The medium loading device according to claim 1, wherein the friction member is an elastic member.

8. The medium loading device according to claim 1, wherein an overhanging portion protruding in the movement direction at a position above the friction member in the device height direction is provided at a side portion of the placement portion located downstream of the downstream end portion in the movement direction.

9. The medium loading device according to claim 8, wherein in the device height direction, the overhanging portion is located below a virtual line connecting a downstream end, of the downstream end portion, located most downstream and a downstream end of the contact surface in the movement direction.

10. The medium loading device according to claim 1, wherein an inclined surface is formed at a section, of the placement portion, upstream of the downstream end portion of the placement portion, and a position, in the device height direction, of the inclined surface becomes higher from upstream toward downstream in the movement direction.

11. A recording system including a recording device and a medium loading device, wherein the recording device includes a storage unit configured to store a recording medium, a transport unit configured to transport the recording medium from the storage unit, a recording unit configured to perform recording on the recording medium transported by the transport unit, and a discharge unit configured to discharge the recording medium on which the recording was performed by the recording unit, the medium loading device includes a placement portion on which at least one sheet of the recording medium discharged from the discharge unit is placed, and a friction member disposed downstream of a downstream end portion of the placement portion in a movement direction, at the placement portion, of the recording medium, and including a contact surface configured to come into contact with a back surface, of the recording medium, facing the placement portion, and the contact surface extends at least in the movement direction at a position lower than a height position of the downstream end portion in a device height direction, wherein the medium loading device is a device that is separate from the processing device.

12. The recording system according to claim 11, wherein the recording medium is roll paper, the recording device includes a cutting unit configured to cut the roll paper, on which the recording was performed by the recording unit, to form a single paper sheet, and the placement portion is configured to be loaded with a plurality of the single paper sheets.

* * * * *